United States Patent [19]

Saito et al.

[11] Patent Number: 4,531,657

[45] Date of Patent: Jul. 30, 1985

[54] TAPPING STOPPER

[75] Inventors: Tadao Saito, Tokyo; Riichi Ogawa, Matsudo, both of Japan

[73] Assignee: Yoshino Kogyosho Co., Ltd., Japan

[21] Appl. No.: 370,292

[22] Filed: Apr. 20, 1982

[51] Int. Cl.[3] ..... B65D 23/06

[52] U.S. Cl. ..... 222/108; 222/571

[58] Field of Search ..... 222/108, 566, 569, 570, 222/571, 109, 111, 478, 547

[56] References Cited

U.S. PATENT DOCUMENTS

| | | | |
|---|---|---|---|
| 3,369,710 | 2/1968 | Lucas | 222/109 |
| 3,459,315 | 8/1969 | Labarre | 222/541 |
| 3,833,150 | 9/1974 | Visser-Patings | 222/571 X |
| 4,264,022 | 4/1981 | Perné et al. | 222/570 X |

FOREIGN PATENT DOCUMENTS

| | | | |
|---|---|---|---|
| 451399 | 8/1936 | United Kingdom | 222/571 |

*Primary Examiner*—Joseph J. Rolla
*Assistant Examiner*—Michael S. Huppert
*Attorney, Agent, or Firm*—Parkhurst & Oliff

[57] ABSTRACT

A tapping stopper for a bottle to prevent the content liquid from trickling along the outside of the bottle. The tapping stopper comprises a pouring cylinder having a trumpet-shaped lip, an auxiliary external cylinder having a trumpet-shaped lip, and a bottom plate connecting the pouring cylinder and the auxiliary external cylinder, the pouring cylinder and the auxiliary external cylinder forming a peripheral groove between them and being arranged at a certain distance in proportion to the viscosity of the content liquid.

3 Claims, 2 Drawing Figures

TAPPING STOPPER

BACKGROUND OF THE INVENTION

1. Field of the Invention

This invention relates to a tapping stopper which is tightly fitted to the mouth of a bottle containing a liquid. The tapping stopper of this invention is intended to prevent the content liquid from trickling along the bottle outside when the content liquid is poured out.

2. Description of the Prior Art

There are many kinds of tapping stoppers which are fitted to the mouth of a bottle containing a liquid to permit the content liquid to be poured out smoothly without trickling. Many of these tapping stoppers have such a structure that the top end has a trumpet-shaped pouring cylinder which prevents trickling effectively.

The tapping stoppers of the aforesaid structure are effective to prevent trickling to some extent, but are not completely effective. They are almost not effective when a viscous liquid is poured out.

The conventional tapping stoppers are effective when the bottle is tilted quickly to pour the content liquid and the bottle is restored quickly again. However, they do not work effectively when the bottle is tilted slowly to pour the content liquid little by little, or when the nearly filled bottle is slightly tilted.

SUMMARY OF THE INVENTION

It is an object of this invention to provide a tapping stopper which is free of the above-mentioned disadvantages.

This invention resides in a tapping stopper in which the pouring cylinder is of double-walled structure, the liquid trickling from the main pouring cylinder is received by an auxiliary pouring cylinder, the liquid thus received is prevented from trickling from the auxiliary pouring cylinder by the surface tension of the content liquid being poured from the main pouring cylinder, whereby trickling is prevented with certainty.

DETAILED DESCRIPTION OF THE INVENTION

Figure 1:
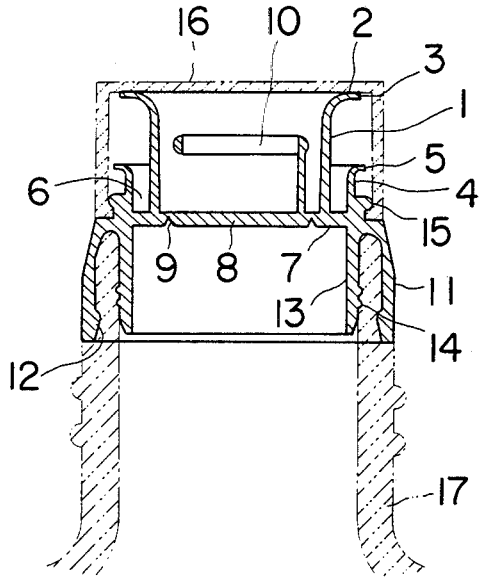
FIG. 1 is a longitudinal sectional view showing one embodiment of the invention.
Figure 2:
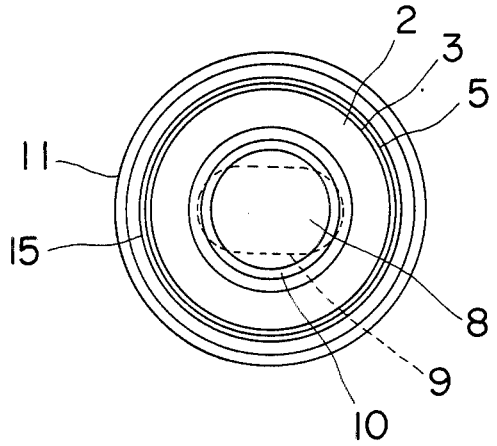
FIG. 2 is a plan view showing the same embodiment of the invention as in FIG. 1.

The invention is described in detail with reference to the drawings showing one embodiment of the invention.

When in use, the tapping stopper of this invention is tightly fitted to the mouth of a bottle 17 containing a liquid. The tapping stopper is made up of the pouring cylinder 1, the auxiliary external cylinder 4, and bottom plate 7. The pouring cylinder 1 has a trumpet-shaped and flattened top end 2. That is, the cylindrical surface of the top end of the pouring cylinder is connected to a perpendicularly extending annular surface by a curved transitional surface. The auxiliary external cylinder 4, which is lower than the pouring cylinder 1, has also a trumpet-shaped top end like that of the pouring cylinder. The pouring cylinder 1 and the auxiliary external cylinder 4 form the narrow circular groove 6 between them. The bottom plate 7 connects the lower ends of the pouring cylinder 1 and the auxiliary external cylinder 4.

The tapping stopper may be tightly fitted to the mouth of a bottle 17 in a proper way which is not specifically limited. In the case of the illustrated embodiment, the tight fitting is accomplished by the structure made up of the internal cylinder 13 and the external cylinder 11. The internal cylinder 13 extends downward from the periphery of the bottom plate 7 and fits into the mouth of a bottle 17 to make a seal with the several ridges 14 formed thereon. The external cylinder 11 extends downward from the periphery of the bottom plate 7 and fits on the mouth of a bottle 17, ensuring locking with a locking ridge 12 formed thereon.

In FIG. 1, it should be noted that the auxiliary cylinder 4 is much lower than the pouring cylinder 1. The difference of the height is determined according to the viscosity of the liquid to be filled in the bottle 17. The higher the viscosity, the greater the difference. The difference is about 6 mm for comparatively viscous liquids like frying oil.

Moreover, it should be noted in FIG. 1 that the lip 5 of the auxiliary cylinder 4 projects outward slightly beyond the lip 3 of the pouring cylinder 1, so that the liquid trickling from the lip 3 of the pouring cylinder 1 is caught certainly by the peripheral groove 6. Another reason for such arrangement is to ensure the prevention of trickling. When the content liquid is poured, the liquid may partly trickle along the lower side of the lip 3 of the pouring cylinder 1, and the trickling liquid is received by the groove 6 and then discharged from the lip 5 of the auxiliary cylinder 4. In such pouring, the flow from the lip 3 of the pouring cylinder 1 pulls up the flow from the lip 5 of the auxiliary cylinder 4 due to surface tension of the content liquid being poured. This action resulting from surface tension ensures the prevention of trickling.

It is also possible to arrange the lip 5 inside the lip 3 so long as trickling is to be prevented by surface tension of the content liquid as above mentioned. However, arranging the lip 5 outside the lip 3 is advantageous in view of the relative position of the two lips, with the bottle tilted for pouring.

The top 2 of the pouring cylinder 1 is made flat so that a certain quantity of content liquid is on the top of the pouring cylinder 1 for effective use of surface tension when the content liquid is poured and that the content liquid remaining in the form of a drop on the end of the lip 3 is returned to the inside of the pouring cylinder when the tilted bottle is restored.

In the case of the illustrated embodiment, the lower end of the pouring cylinder 1 is closed with the extension of the bottom plate 7. The extension is provided with the cutting groove 9, the removable piece 8, and the pulling ring 10. The lower periphery of the auxiliary cylinder 4 is provided with a ridge 15 which engages with the cap 16.

Before pouring the content liquid for the first time, the consumer opens the bottle 17 by pulling up the pulling ring 10 until the removable piece 8 is broken along the cutting groove 9.

The content liquid is poured when the bottle 17 is tilted, but the content liquid trickles along the underside of the lip 3 of the pouring cylinder 1 when the tilt angle is changed to adjust the pouring quantity. The content liquid which has trickled along the underside of the lip 3 of the pouring cylinder 1 is received by the peripheral groove 6 and then poured out along the auxiliary external cylinder 4.

When the bottle 17 is tilted to such a position that the content liquid pours from the lip 5 of the auxiliary cylinder 4, the content liquid pours from the lip 3 of the pouring cylinder 1 as a matter of course. Thus, the flow from the lip 5 is attracted by the flow from the lip 3 due to the surface tension of the content liquid. In this manner, the content liquid is prevented from trickling along the tapping stopper.

If the distance between the lip 3 and the lip 5 is too short as compared with the viscosity of the content liquid, the content liquid will bridge the two lips. This decreases the effect of surface tension and hence greatly deteriorates the effect of preventing trickling.

The liquid pouring from the lip 3 exerts an upward force on the liquid pouring from the lip 5 due to surface tension. In the same way, the liquid pouring from the lip 5 exerts a downward force on the liquid pouring from the lip 3. However, the combined flow starts from the point near the lip 3, and it never occurs that the content liquid trickles along the underside of the lip 5 of the auxiliary external cylinder 4.

It is to be noted that it is the secondary function for the periphral groove 6 formed between the pouring cylinder 1 and the auxiliary external cylinder 4 to receive the liquid trickling along the outside of the pouring cylinder 1. The principal object is to permit the liquid guided by the auxiliary cylinder 4 to be combined with the main flow pouring from the pouring cylinder 1 due to affinity for the peripheral surface of the pouring cylinder 1. Therefore, the peripheral groove 6 is not so wide; it is about 2.5 to 3 mm for viscous liquids like frying oil.

As above mentioned, the tapping stopper of this invention is capable of preventing the content liquid, even when it is viscous, from trickling along the stopper. This effect is achieved due to the viscosity of the content liquid, and therefore, the action is certain and the structure is simple and easy to make.

What is claimed is:

1. A tapping stopper for use on the mouth of a bottle containing a liquid to be poured, said tapping stopper comprising:

a pouring cylinder comprising:

a first cylindrical surface, a first annular lip extending perpendicularly to an axis of said first cylindrical surface, and a first transitional surface;

said first transitional surface having a first curved surface joining an end of said first cylindrical surface and an inner diameter of said first annular lip;

an auxiliary cylinder coaxially surrounding said pouring cylinder and said auxiliary cylinder comprising:

a second cylindrical surface, a second annular lip extending perpendicularly to an axis of said second cylindrical surface, and a second transitional surface;

said second transitional surface having a second curved surface joining an end of said second cylindrical surface and an inner diameter of said second annular lip; and a bottom plate coupled between said pouring cylinder and said auxiliary cylinder to define a circular groove surrounding said pouring cylinder between said pouring cylinder and said auxiliary cylinder, said lip of said auxiliary cylinder being spaced from and below said lip of said pouring cylinder by a distance such that when pouring liquid through said pouring cylinder, some of the liquid enters the circular groove and is then poured from the auxiliary cylinder, and the flow of liquid from the lip of said pouring cylinder pulls up the flow of liquid from said auxiliary cylinder due to surface tension of the liquid to form a combined liquid flow.

2. The tapping stopper of claim 1 wherein the pouring cylinder and said auxiliary cylinder have a common cylindrical axis and the lip of said auxiliary cylinder extends in a radial direction from said axis a greater distance than the radial distance of the lip of said pouring cylinder from said axis.

3. The tapping stopper of claim 2 wherein the lip of said pouring cylinder is spaced from the lip of said auxiliary cylinder by a distance of 6 mm and the auxiliary cylinder is spaced from said pouring cylinder by a distance such that said groove is 2.5 mm to 3 mm.

* * * * *